US005880667A

United States Patent [19]

Altavela et al.

[11] Patent Number: 5,880,667

[45] Date of Patent: Mar. 9, 1999

[54] SYSTEM FOR INDICATING HIGH TEMPERATURE EVENT IN AN ELECTRICAL POWER EQUIPMENT ENCLOSURE

[75] Inventors: Edward T. Altavela, Webster, N.Y.; Glenn R. McComber, Jr., Venice, Fla.

[73] Assignee: Breaker Spot, Ltd., Sarasota, Fla.

[21] Appl. No.: 942,428

[22] Filed: Oct. 1, 1997

[51] Int. Cl.[6] ..... H01H 37/52; H01H 37/08; G08B 19/00

[52] U.S. Cl. ..... 337/376; 337/333; 337/359; 116/221; 116/216

[58] Field of Search ..... 337/3, 14, 15, 337/16, 36, 332, 333, 79, 379; 374/159, 205, 208; 116/4, 5, 101, 102, 200, 207, 216, 221, 217, 218

[56] References Cited

U.S. PATENT DOCUMENTS

| | | | |
|---|---|---|---|
| 3,443,258 | 5/1969 | Dunham et al. . | |
| 3,552,350 | 1/1971 | Ranney et al. . | |
| 4,176,618 | 12/1979 | Hubert | 116/102 |
| 4,237,367 | 12/1980 | Pecota | 219/265 |
| 4,421,053 | 12/1983 | Volk | 116/218 |
| 5,461,367 | 10/1995 | Altavela et al. . | |

OTHER PUBLICATIONS

"Preventive Maintenance Aids Business Survival" by Jim Rosenfield, Electrical Contractor—Jun. 1994, pp. 75–77 & 88.

*Primary Examiner*—Leo P. Picard
*Assistant Examiner*—Anatoly Vortman
*Attorney, Agent, or Firm*—Eugene Stephens & Associates

[57] ABSTRACT

An indicator movable between a set and an alarm position is latched in the set position by a thermally responsive latch disposed to sense ambient temperature within electrical equipment. If a high temperature event occurs, the latch releases the indicator, which moves under resilient bias to its indicating position to present a visible signal that such an event has occurred. Once temperature has dropped below the alarm value within the electrical equipment, the indicator can be moved back to the set position where it is relatched for continued temperature sensing.

19 Claims, 4 Drawing Sheets

SYSTEM FOR INDICATING HIGH TEMPERATURE EVENT IN AN ELECTRICAL POWER EQUIPMENT ENCLOSURE

FIELD OF INVENTION

The invention involves a way of indicating that a high temperature event has occurred in electrically powered equipment that can overheat.

BACKGROUND

This invention recognizes the importance of early detection of potentially hazardous conditions causing increased ambient temperatures within electrical equipment. A high temperature event within a circuit breaker, an electrical panel, electric load center, or similar equipment can be symptomatic of many potentially dangerous conditions such as: loose, corroded, or faulty wire terminal connections; loose, burned, or corroded breaker-to-bus connections; an unbalanced circuit or distribution system; overloads; faults or defects in circuit breakers or other components; or worse, an electrical fire.

For such conditions to remain undetected can cause anything from minor intermittent power outages to total blackouts or catastrophic electrical fires. The consequences of these can be otherwise avoidable loss in productivity from equipment failure and unnecessarily expensive repairs that are caused by system components being burned or melted, which early detection might have avoided.

Because electric panels, load centers, motor controls, circuit breakers, and the like are not generally under constant visual surveillance, this invention recognizes a need for an alarm sensor with the capability of constantly monitoring the internal ambient temperatures within an electrical equipment enclosure and visually displaying an indication that an alarm event has occurred.

Other temperature indicators and alarms have been suggested for electrical equipment. These include the electric panel fire alarm of U.S. Pat. No. 5,461,367, which detects abnormally high ambient temperature within an electrical panel cabinet and actuates an alarm. This requires alarm components supplied with electrical power.

A self-adhesive high temperature indicator is available for use on circuit breakers. When the exterior of the circuit breaker reaches an alarm temperature, the indicator turns permanently from one color to another. While this type of indicator has some value, it suffers from a relatively short service life and must be discarded after experiencing a high temperature event.

Circuit breakers can visually indicate a tripped condition, as suggested in U.S. Pat. No. 3,443,258. While this type of indicator also has value, it depends upon the ability of the circuit breaker itself to trip when excessive current occurs. The June 1994 issue of ELECTRICAL CONTRACTOR reports on a study concluding that about half of circuit breakers installed for at least five years fail to trip when subjected to excessive current. A trip failure also fails to produce any visual indication.

Mechanical fire alarms such as suggested in U.S. Pat. No. 3,552,350 can produce a visual indication that an alarm motor spring has become unwound. While this can indicate the condition of the alarm spring, it does not necessarily indicate a high temperature event. Also, mechanical fire alarms have not been associated with electrical equipment and are too complicated and expensive to succeed as indicators in today's marketplace.

SUMMARY OF THE INVENTION

This invention meets the need for sensing and indicating a high temperature event in electrical equipment with a device that is simple, inexpensive, and resetable. It preferably includes an indicator that is movable between a set position and an alarm position in which the indicator is readily visible. The indicator is biased to move from the set position to the alarm position and is held in the set position by a latch that is responsive to ambient temperature within electrical equipment without being responsive to electric current within the equipment. The latch is movable from a latched position to an unlatched position in response to the ambient temperature within the electrical equipment reaching a predetermined alarm temperature. In the latched position, the latch engages and holds the indicator in the set position so long as the temperature within the electrical equipment remains below the alarm temperature. When an alarm temperature is reached within the equipment, the latch releases the indicator from the set position and the indicator moves to the alarm position where it visually indicates that a high temperature event has occurred. After the temperature within the equipment drops below the alarm temperature, the indicator can be reset to the set position where it is relatched by the latch to resume monitoring ambient temperature.

Movement of the latch or the indicator can be used to actuate an alarm or inform a monitor that can be arranged in any convenient place. The latch is preferably a bimetallic element arranged for moving in a direction transverse to the movement of the indicator. The ability of the indicator to be reset allows it to be operated indefinitely and can help in diagnosing the cause of an over temperature event.

DRAWINGS

DETAILED DESCRIPTION

Figure 1:
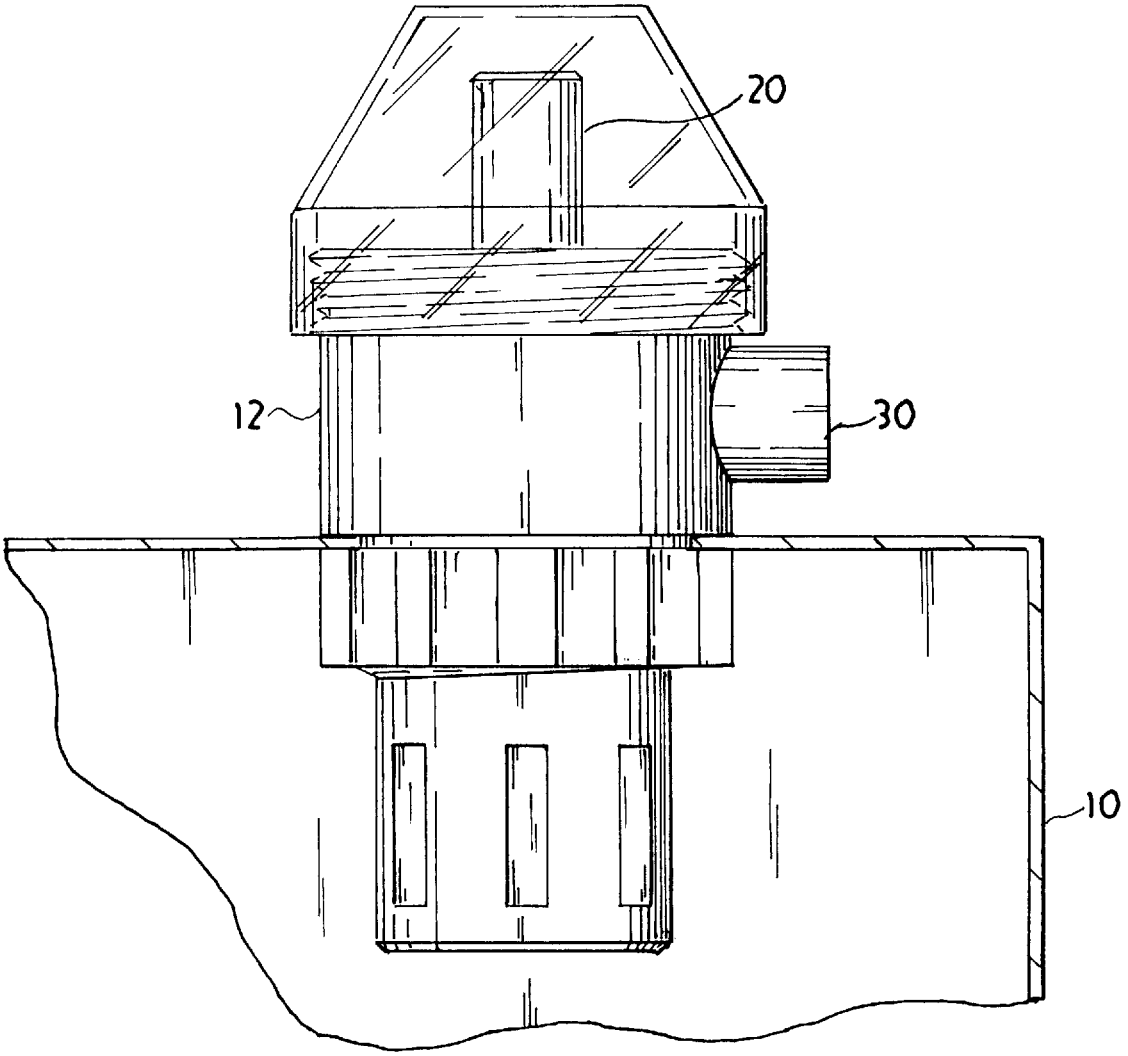
FIG. 1 is a fragmentary and partially cut-away elevational view of a preferred embodiment of the inventive indicating system installed on an electric enclosure.
Figure 2:
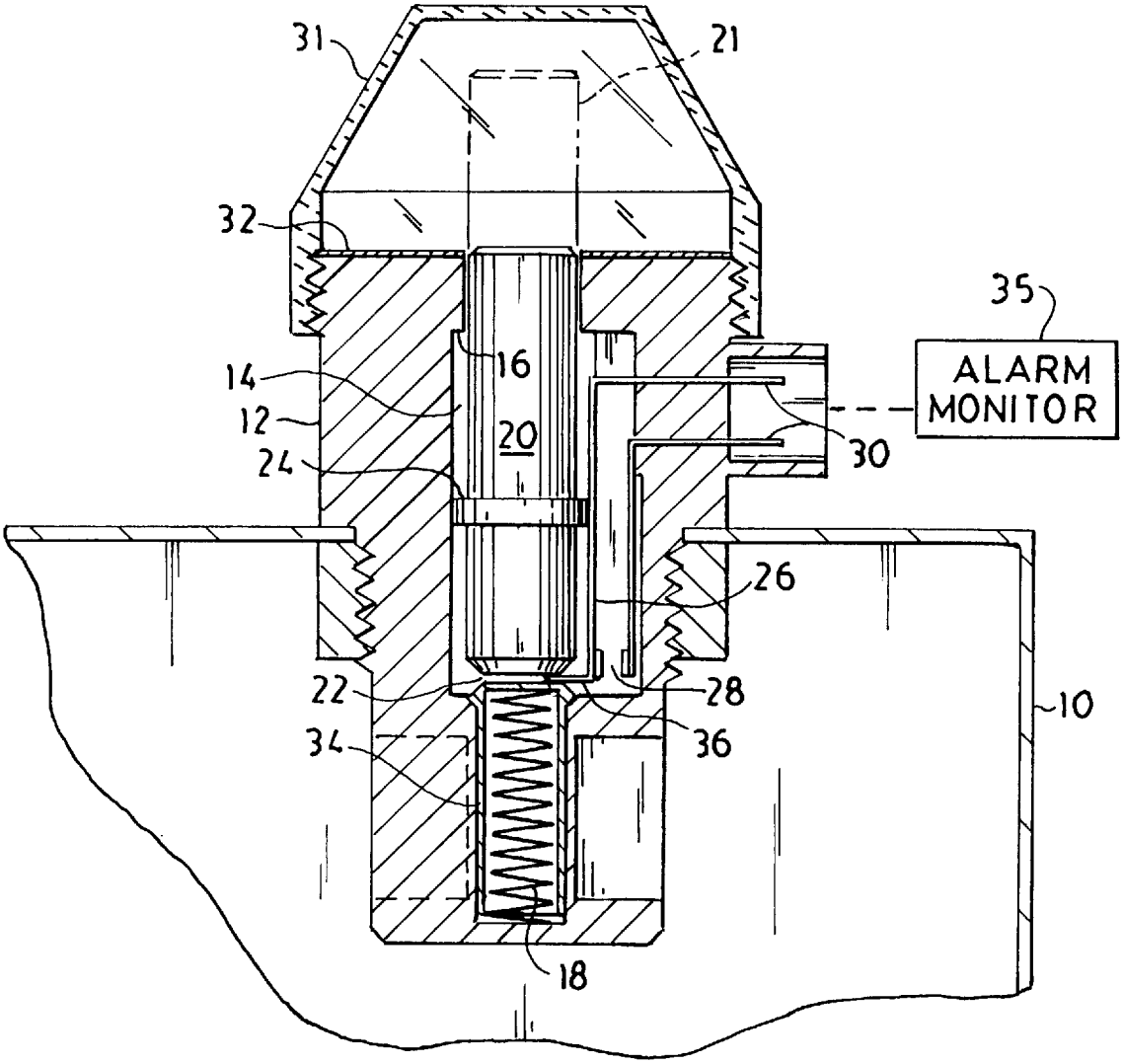
FIG. 2 is a partially schematic, cut-away view of the indicator of FIG. 1.

A preferred embodiment of the invention as illustrated in FIGS. 1 and 2 has components enclosed within a body 12 that is attached to an electric panel 10 or other electric equipment cabinet or box, preferably through a knock-out opening and preferably on the top or on an upper region of the sides or cover of enclosure 10. This places the device in a region that will become hot from any source of high temperature.

Figure 2A:
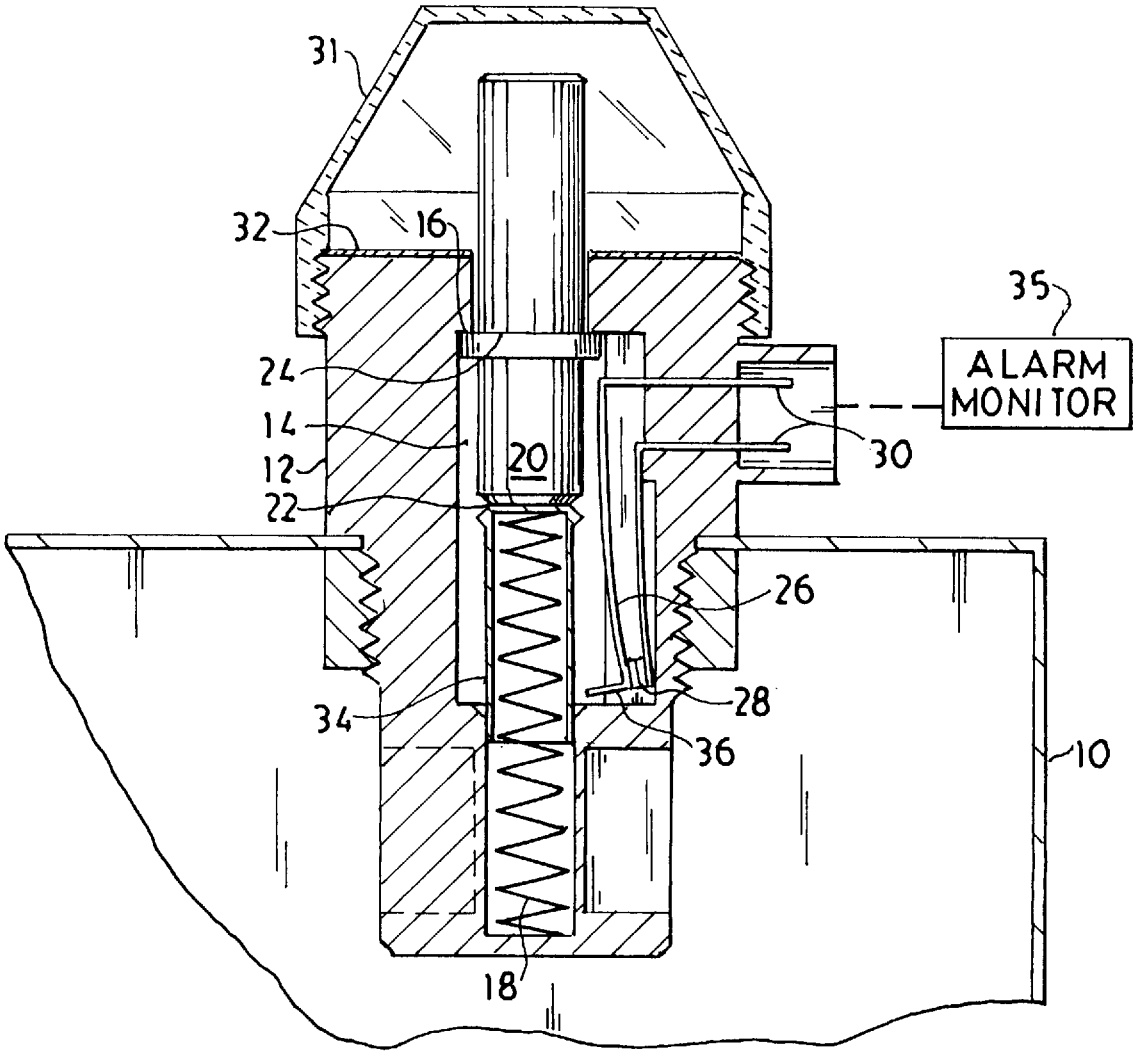
FIG. 2A is a partially schematic, cut-away view similar to the view of FIG. 2, but showing the indicator in an actuated position.

The components within body 12 are arranged so that when body 12 is mounted as illustrated, bimetallic latch 26 is disposed within enclosure 10 in a position to sense ambient temperature within enclosure 10. An indicator 20 is arranged for moving within body 12 between a set position illustrated in solid lines in FIG. 2 and an alarm position shown in FIG. 1 and illustrated in FIG. 2A. Compression spring 18 biases indicator 20 for movement from the set position to the alarm position. Spring 18 is arranged within a spring housing 34 formed in a recessed lower end of indicator 20 so that spring 18 engages indicator 20 and the bottom of housing 12.

Indicator 20, as illustrated in FIGS. 1 and 2, is piston-shaped and arranged within a cylinder 14 formed in body 12. Indicator 20 can move upward from its set position to be readily visible within protective cover 31 in a pop-up alarm position. A stop 24 formed as a collar around indicator 20 engages a cylinder stop 16 to limit upward movement of indicator 20 beyond the popped-up indicating position. The spring end of cylinder 14 is closed to limit downward motion, and the stop collar 24 limits upward motion so that the indicator is trapped within housing 12.

Indicator 20 can have many other shapes, though, and can move in pivotal as well as linear directions. Also, a bias force to cause the necessary movement of indicator 20 can be formed as a variety of springs and resilient elements. Simplicity, compactness, and economy of manufacture are important; but many structural variations can approach these goals.

Bimetallic latch 26 is assembled into housing 12 so that a movable end 36 normally engages a notch or detent 22 in indicator 20 for holding indicator 20 in the set position. So long as temperature within enclosure 10 remains below a predetermined alarm value, end 36 of bimetallic arm 26 stays latched in detent 22 and prevents movement of indicator 20 from its set position. When temperature within enclosure 10 reaches the alarm value, bimetallic arm 26 bends enough to move its free end 36 out of detent 22 and release indicator 20, which then moves under the bias of spring 18 to the alarm position shown in FIG. 1 and in a broken line extension 21 in FIG. 2. In the alarm position, indicator 20 is clearly visible under a clear protective cap 31. Indicator 20 stays in the alarm position after a high temperature event has occurred, even though the interior of enclosure 10 may cool down after such an event. Indicator 20 thus produces a visible sign that a high temperature event has occurred, which shows that equipment within enclosure 10 should be investigated.

Bimetallic and other temperature-responsive elements can be arranged in many different ways to latch and hold a movable indicator and release the indicator upon occurrence of a high temperature event. Any preferred arrangement thermally moves the latch transversely of the motion of the indicator. Different notches, projections, and latches for an indicator can cooperate with various bimetallic elements to hold the indicator in a set position until an alarm temperature has occurred.

The embodiment of FIG. 2 also illustrates the possibility of adding optional auxiliary contacts 28 that are actuated to change state and serve as a switch upon movement of bimetallic arm 26 in response to an alarm temperature. Normally open contacts 28 can close a circuit for remote alarm or monitoring purposes through external terminals 30, and these can be connected to a monitoring system or alarm 35. (Contacts 28 can also be normally closed and arranged to open in response to an alarm temperature.) Contacts 28 can be arranged to remain closed after any actuation of indicator 20 or to reopen whenever temperature within enclosure 10 drops back down below an alarm level. Each alternative has advantages. For contacts 28 to remain closed after an alarm temperature event can provide historical information to a monitor as a duplication of the visual indication provided by indicator 20. For contacts 28 to reopen when the interior of enclosure 10 cools provides the added information that the high temperature event that caused indicator 20 to trip is no longer occurring and temperature within enclosure 10 has returned to a subalarm value. This can be verified by resetting indicator 20, which will successfully latch after enclosure 10 has cooled.

After an alarm temperature event in enclosure 10 and after temperature within enclosure 10 has dropped below the alarm value, indicator 20 can be reset by removing cap 31 and pressing indicator 20 downward within cylinder 14. This recompresses bias spring 18 and allows the end 36 of bimetallic element 26 to relatch into detent 22 for again holding indicator 20 in a set position. If temperature within enclosure 10 is still above an alarm value, then an attempted reset will fail to latch indicator 20 and will show that a dangerous condition still exists.

If contacts 28 are employed in cooperation with bimetallic arm 26, the closure of contacts 28 after an alarm temperature event can be controlled by the diameter of spring housing 34. Giving housing 34 a diameter equal to notch 22 allows contacts 28 to reopen after cooling within enclosure 10 following an alarm temperature event. Giving housing 34 a larger diameter than notch 22 can hold contacts 28 closed until a reset occurs after an alarm temperature event.

In operation, indicator 20 remains in its set position so long as temperatures within enclosure 10 remain below a predetermined alarm value. Whenever ambient temperature within enclosure 10 reaches an alarm value, bimetallic arm 26 bends sufficiently so that its end 36 retracts from and releases detent 22, which allows indicator 20 to pop up to its indicator position under the bias of spring 18. If auxiliary contacts 28 are employed, these are closed, either by the movement of bimetallic arm 26 or by the movement of indicator 20 from its set to its alarm position. Indicator 20 then gives a clear visual indication that an alarm temperature event has occurred within enclosure 10, and an alarm or other monitoring of this event may also be actuated. A glance at indicator 20 is all that is needed for an observer to become informed.

An alarm temperature event may signify an electrical problem within enclosure 10; and once such an occurrence is indicated, its cause can be investigated. A raised indicator 20 clearly signifies that a high temperature event has occurred, but does not indicate whether such an event is still occurring. This can be determined by attempting to reset indicator 20. If indicator 20 cannot be relatched by bimetallic element 26, this tells an investigator that temperature within enclosure 10 remains above the alarm value. If indicator 20 can be relatched into the set position, an investigator knows that temperature within enclosure 10 has dropped below the alarm value and that whatever caused the high temperature event is no longer occurring. The ability of the indicator to be reset also allows it to be used indefinitely regardless of the number of high temperature events that may occur.

The upper end of indicator 20 is preferably brightly colored in yellow, orange, or red to enhance its visibility in a popped-up alarm state. The area 32 around indicator 20 is preferably a different contrasting color so that the difference between the set and alarm positions of alarm indicator 20 are readily discernible.

Figure 3:
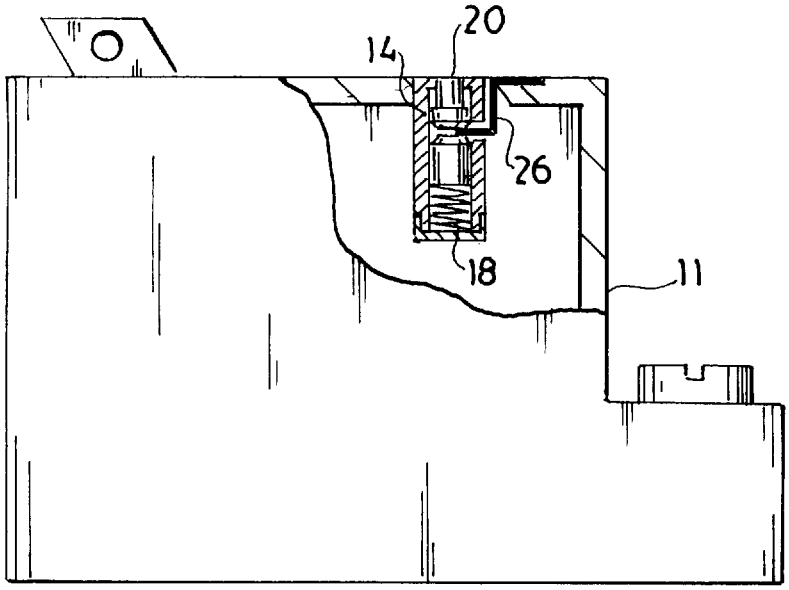
FIGS. 3 and 4 are partially schematic, partially cut-away views of a circuit breaker equipped with a preferred embodiment of the inventive indicator shown in a set position in FIG. 3 and in an alarm-indicating position in FIG. 4.
Figure 4:
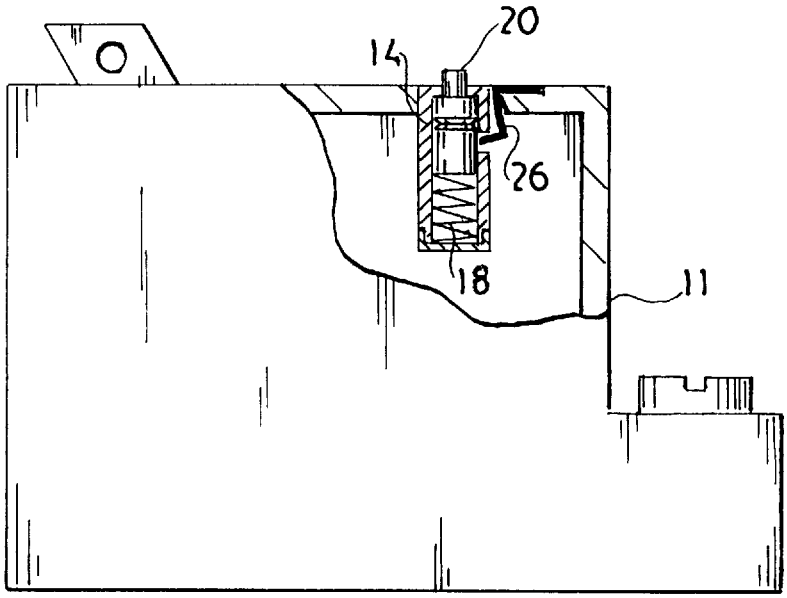

FIGS. 3 and 4 schematically show an indicator similar to the ones shown in FIGS. 1 and 2 combined with a circuit breaker 11. The indicator is preferably recessed into circuit breaker 11 so that bimetallic element 26 is in a position to sense an internal ambient temperature within circuit breaker 11. Otherwise, indicator 20 and spring 18 are arranged for a pop-up indication similar to that described for FIGS. 1 and 2.

Circuit breaker 11 can overheat in response to several electrical defects that may not cause circuit breaker 11 to trip. Also, circuit breaker 11 can be one of the majority of circuit breakers deployed in the field for more than five years, which no longer trips reliably. Indicator 20 can perform a valuable service in indicating an over temperature event within circuit breaker 11 that otherwise might go undetected. A visual signal from indicator 20 that an over temperature event has occurred can lead to an investigation and correction of an electrical defect or condition that might otherwise cause a serious problem. It could also lead to a determination that circuit breaker 11 is defective and should be replaced.

The illustrated indicators have been selected for their simplicity and low cost. There are many ways that such an indicator can be changed by varying configuration and movement paths of an indicator and a latch. Bias elements can also vary, as can latch detents and auxiliary contacts that are closed or open upon occurrence of a high temperature event.

We claim:

1. A system for indicating high temperature occurring within an electrical power equipment enclosure, the system comprising:

a. an indicator combined with the electrical power equipment enclosure so that the indicator is movable between a set position and an alarm position in which the indicator is readily visible outside the electrical power equipment enclosure, the indicator being biased to move from the set position to the alarm position;

b. a latch arranged to be responsive to ambient temperature within the electrical power equipment enclosure without being responsive to electric current flowing in electrical power equipment within the enclosure;

c. the latch being movable from a latched position to an unlatched position in response to the ambient temperature within the electrical power equipment enclosure reaching a predetermined alarm temperature;

d. the latch in the latched position engaging and holding the indicator in the set position so long as the temperature within the electrical power equipment enclosure remains below the alarm temperature;

e. the latch releasing the indicator from the set position when the latch moves to the unlatched position in response to the alarm temperature within the enclosure so that the indicator moves to the alarm position where the indicator visibly indicates that an alarm temperature event has occurred within the enclosure; and f. the indicator being movable from the alarm position back to the set position to be latched in the set position by the latch when temperature within the equipment enclosure drops below the alarm temperature.

2. The system of claim 1 wherein the electrical power equipment enclosure is a circuit breaker and the latch is responsive to ambient temperature within the circuit breaker.

3. The system of claim 1 including a switch actuated upon movement of the latch to the unlatched position and movement of the indicator to the alarm position.

4. The system of claim 3 wherein latch movement actuates the switch.

5. The system of claim 3 wherein the switch actuates an alarm or a monitor.

6. The system of claim 1 wherein the latch is a bimetallic element arranged for moving in a direction transverse to the movement of the indicator from the set position to the alarm position.

7. A method of indicating that a temperature within an electrical power equipment enclosure has reached a predetermined alarm value, the method comprising:

a. arranging an indicator in combination with the electrical power equipment enclosure so that the indicator is movable between a set position and a high temperature event position in which the indicator is readily visible outside the enclosure;

b. biasing the indicator to move from the set position to the high temperature position;

c. latching the indicator in the set position with a movable latch that is arranged to be responsive to ambient temperature within the enclosure without being responsive to electric current flowing in electrical power equipment within the enclosure so that the latch holds the indicator in the set position at temperatures below the alarm value and moves to an unlatched position releasing the indicator for movement to the high temperature position in response to temperature within the enclosure reaching the alarm value; and d. after visibly indicating that an alarm temperature event has occurred within the enclosure and after temperature in the enclosure has returned to a value below the alarm value, resetting the indicator by moving the indicator back to the set position where the indicator is latched and held by the latch.

8. The method of claim 7 including arranging the indicator and the latch within a circuit breaker so that the latch is responsive to ambient temperature within the circuit breaker and the indicator is visible outside the circuit breaker.

9. The method of claim 7 including actuating an electric switch upon movement of the latch and the indicator in response to the alarm temperature.

10. The method of claim 9 including actuating the switch by latch movement.

11. The method of claim 9 including using activation of the switch to actuate an alarm or a monitor.

12. The method of claim 7 including selecting a bimetallic element for the latch and arranging the element to move transversely of the motion of the indicator from the set position to the alarm position.

13. The method of claim 7 including pressing on a visible end of the indicator to move the indicator to the set position.

14. A device for indicating an alarm temperature event occurring within an electrical power equipment enclosure, the device comprising:

a. an indicator latch arranged to be responsive to ambient temperature within the enclosure without being responsive to electric current flowing in electrical power equipment within the enclosure, the latch being movable between a latched position maintained during temperatures below a predetermined alarm temperature and an unlatched position moved to in response to the alarm temperature occurring within the enclosure;

an indicator movable in a direction transverse to the movement of the latch and arranged so that the indicator is held in a set position by the latch in the latched position while temperature within the enclosure stays below the alarm temperature;

the indicator being released by the latch in response to an alarm temperature event occurring within the enclosure, and the indicator being biased to move from the set position to an alarm position where the indicator is visible outside the enclosure to indicate that an alarm temperature event has occurrred within the enclosure; and d. the indicator being movable from the alarm position to the set position to be held by the latch in the set position after temperature within the enclosure returns to a value below the alarm temperature.

15. The device of claim 14 wherein the electrical power equipment enclosure is a circuit breaker, the latch is responsive to ambient temperature within the circuit breaker, and the indicator is visible outside the circuit breaker.

16. The device of claim 14 including a switch actuated upon movement of the latch to the unlatched position and movement of the indicator to the alarm position.

17. The device of claim 16 wherein latch movement actuates the switch.

18. The device of claim 16 wherein the switch actuates an alarm or a monitor.

19. The device of claim 14 wherein the latch is a bimetallic element arranged for moving in a direction transverse to the movement of the indicator from the set position to the alarm position.

* * * * *